US005575420A

United States Patent [19]

Whitnell

[11] Patent Number: 5,575,420

[45] Date of Patent: Nov. 19, 1996

[54] COMPARTMENT CARTON

[75] Inventor: Simon Whitnell, Exton, Pa.

[73] Assignee: Dopaco, Inc., Downingtown, Pa.

[21] Appl. No.: 568,467

[22] Filed: Dec. 7, 1995

[51] Int. Cl.[6] ..... B65D 5/4805

[52] U.S. Cl. ..... 229/104; 229/114; 229/120.17; 229/904; 229/906

[58] Field of Search ..... 229/104, 114, 229/120.18, 120.21, 902, 904, 906, 908, 120.17

[56] References Cited

U.S. PATENT DOCUMENTS

| | | | |
|---|---|---|---|
| 2,455,706 | 12/1948 | Shaw | 229/104 |
| 3,184,050 | 5/1965 | Dahlberg et al. | 229/104 |
| 3,858,787 | 1/1975 | Bamburg et al. | 229/104 |
| 4,030,596 | 6/1977 | Snyder et al. | 229/104 |
| 4,185,764 | 1/1980 | Cote | 229/104 |
| 4,339,068 | 7/1982 | Brauner | 229/904 |
| 4,431,128 | 2/1984 | Dirico . | |
| 4,489,879 | 12/1984 | Mode . | |
| 4,497,433 | 2/1985 | Wischusen, III . | |
| 4,653,685 | 3/1987 | Leary et al. . | |
| 4,694,987 | 9/1987 | Forbes, Jr. . | |
| 4,848,648 | 7/1989 | Eisman . | |
| 5,277,920 | 1/1994 | Weaver, Jr. . | |
| 5,289,943 | 3/1994 | Powell | 229/104 |
| 5,364,018 | 11/1994 | Carlsson | 229/120.17 |

*Primary Examiner*—Gary E. Elkins
*Attorney, Agent, or Firm*—Dennison, Meserole, Pollack & Scheiner

[57] ABSTRACT

A carton including a tray having two compartments therein divided by a transverse divider wall with the bottom panel of one compartment integral with the lower edge of the divider wall and the bottom panel of the second compartment integral with the upper edge of the divider wall and sloping outwardly and downwardly therefrom to substantially a common plane with the first compartment bottom panel. The tray is surrounded by confining walls, and the carton may include a cover separately formed or integral with the tray.

20 Claims, 4 Drawing Sheets

Fig. 5
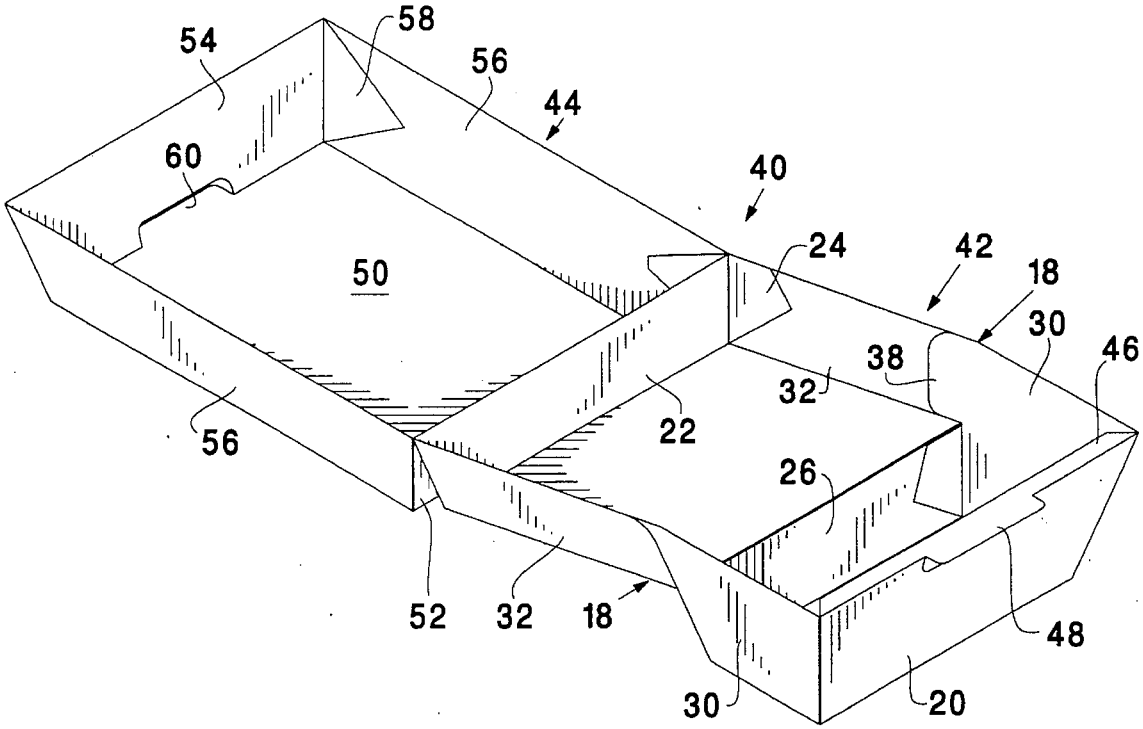
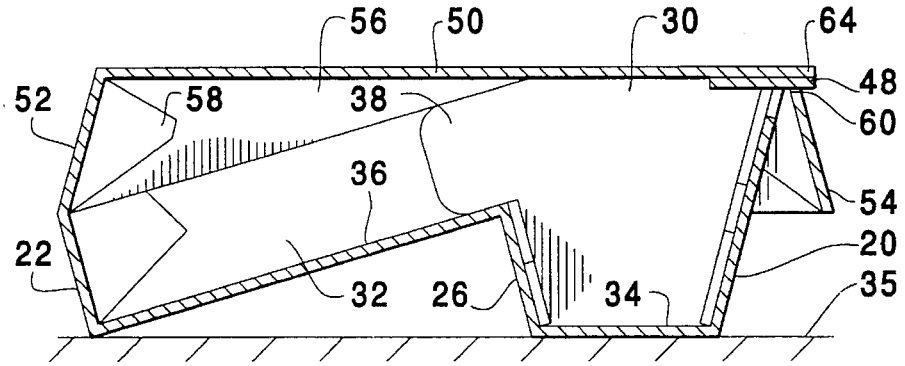
Fig. 6

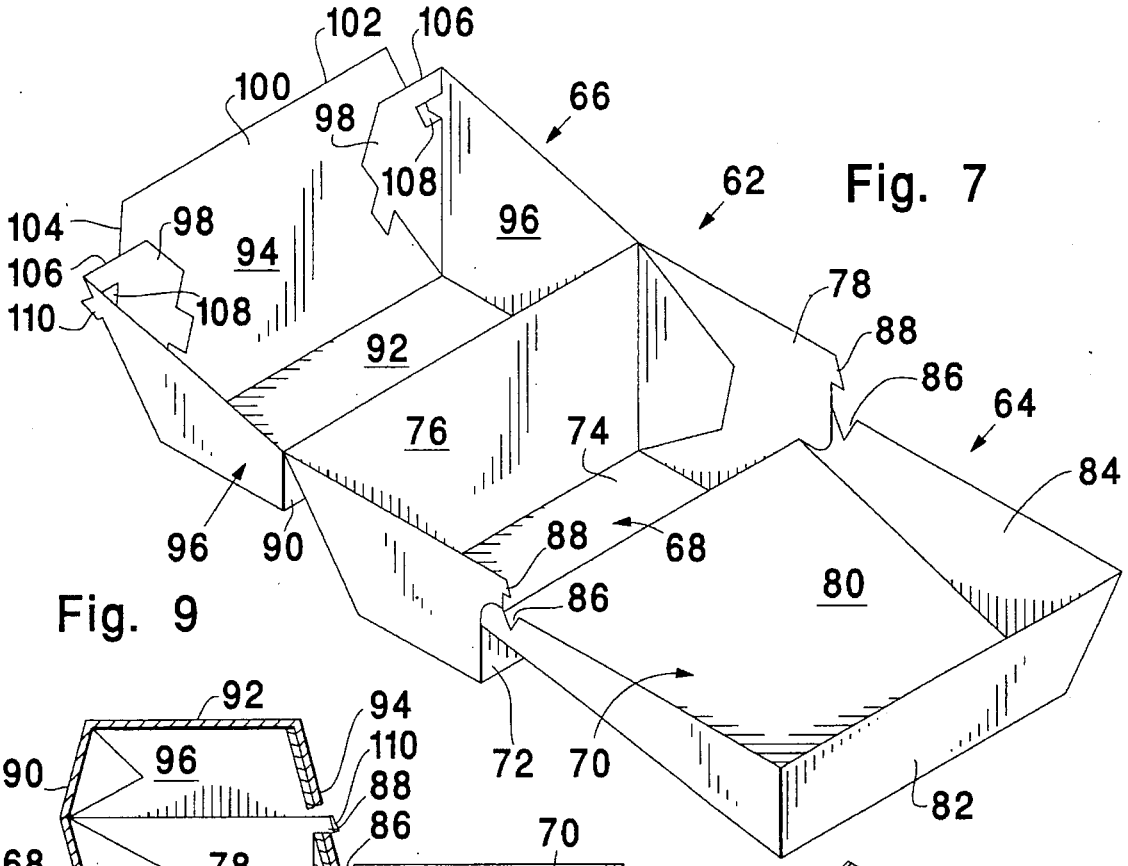
Fig. 7
Fig. 9
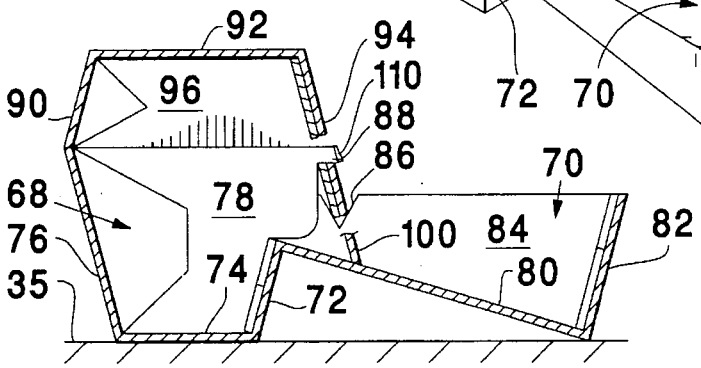
Fig. 10
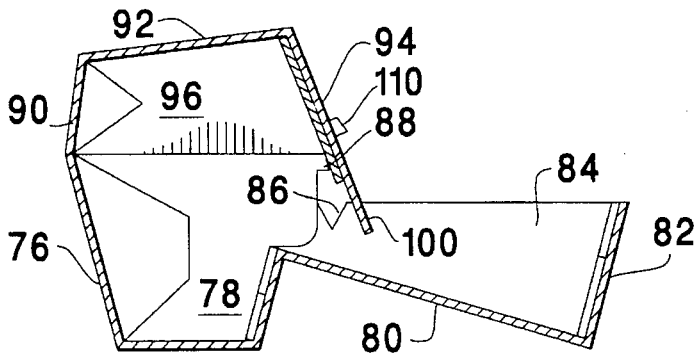
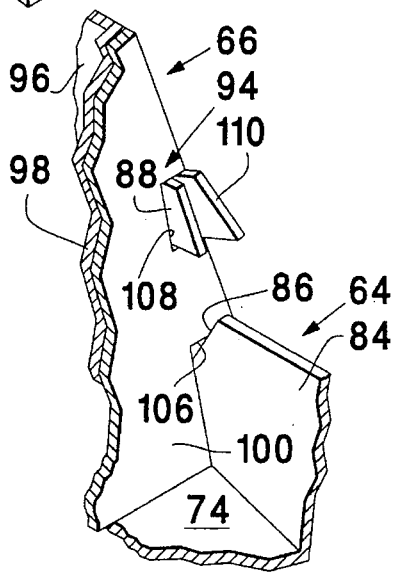
Fig. 8

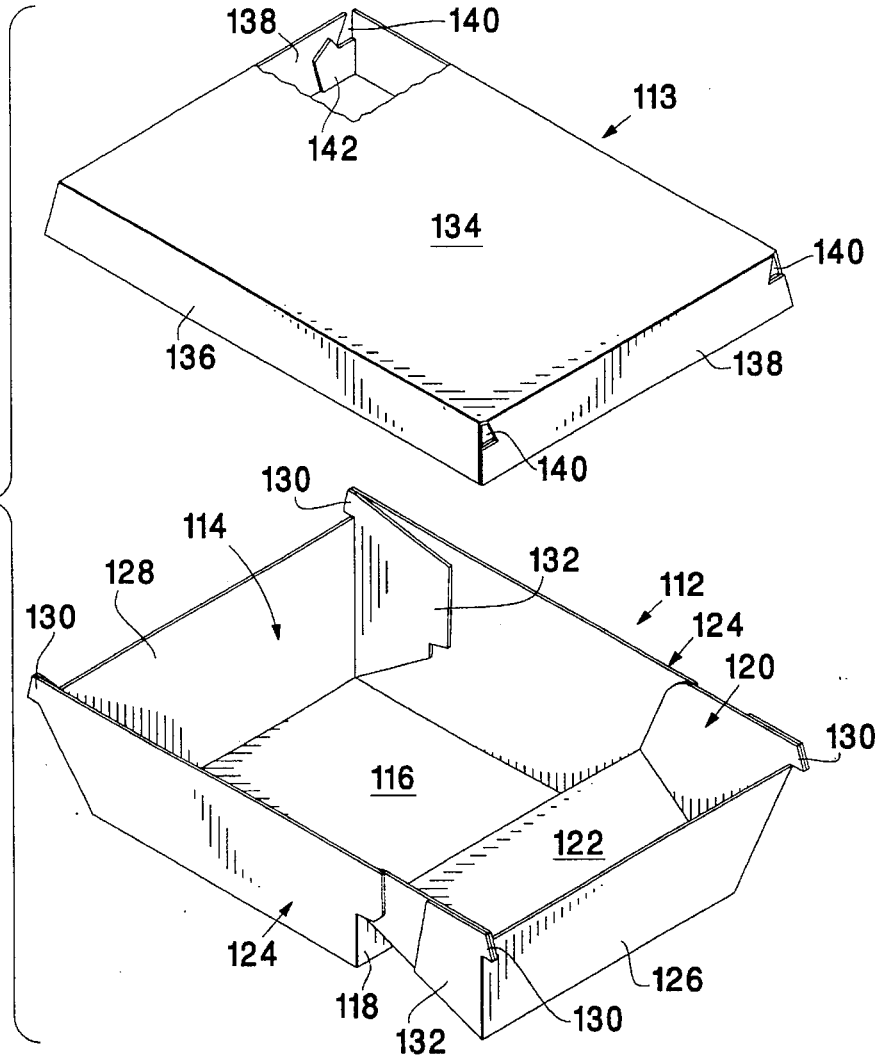
Fig. 11
Fig. 13
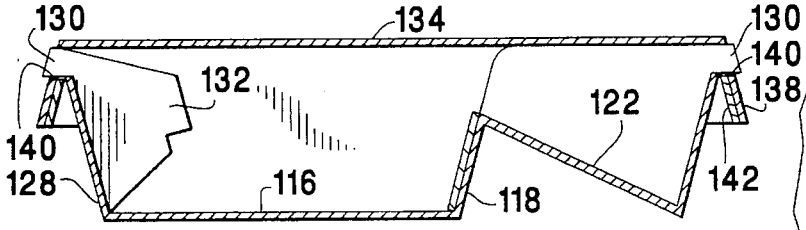
Fig. 14
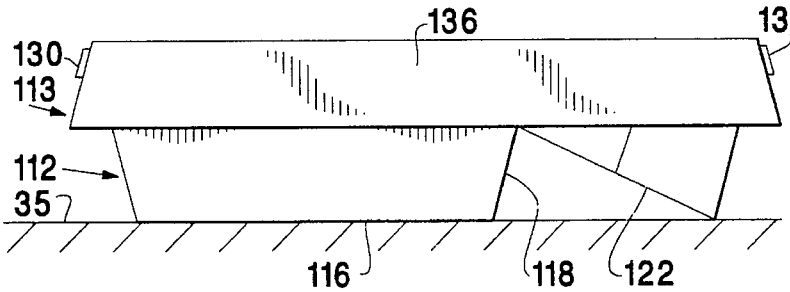
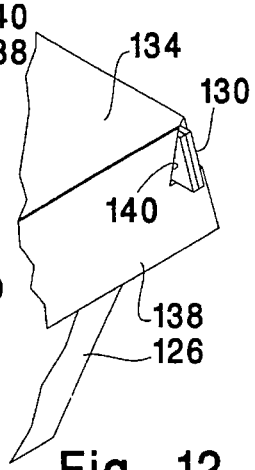
Fig. 12

COMPARTMENT CARTON

BACKGROUND OF THE INVENTION

Containers for use in the serving of "fast food", to be practical, should ideally meet several basic goals. The container should be inexpensive, as the container is normally a single use, throw-away item. This usually suggests the use of folded paperboard cartons. Such paperboard cartons, either fully or partially assembled, have also been found to be particularly adapted for compact nesting and storage, a significant factor in reducing shipping and storage costs.

It is also important that the container have insulative qualities particularly where heated foodstuffs are to be maintained warm and/or foodstuffs of different temperatures are to be separately maintained, at the appropriate temperatures, in a single carton. Such features normally suggest the use of a more expensive foamed polystyrene container along with its attendant problems of disposal in an environmentally correct manner.

While savings are effected in the use of compartmented cartons for two separate foods, as compared to separate cartons for each food, such compartmented cartons, whether of foamed polystyrene or paperboard, require a rather elaborately constructed partition wall between the compartments to clearly segregate the foods against co-mingling and in a manner as to prevent heat transfer. Such partitions in paperboard cartons also frequently involve rather elaborate folding procedures and frequently give rise to the possibility of leakage between the compartments.

SUMMARY OF THE INVENTION

The carton of the present invention is formed of an appropriate foldable paperboard material of the type conventionally used in fast food containers. In addition to achieving the advantages inherent in paperboard fast food containers, the carton of the invention uniquely provides for multiple compartments which are physically segregated from each other with no possibility of leakage between the compartments. The carton also provides for a positive thermal barrier precluding heat transfer between the foods received in the separate compartments. Similarly, the carton, notwithstanding the formation thereof from conventional paperboard material, provides the additional advantage of greatly reducing external condensation buildup such as, in the conventional hot food container, frequently and undesirably transfers to a table top or car seat.

The advantages of the invention, heretofore not available in a practical manner in a single carton, are achieved by a unique carton construction formed from a single or unitary blank of foldable paperboard, cardboard or the like. A minimal amount of material is required, and the basic folding steps involved are straightforward and not particularly complex, as compared to a conventional multi-compartment carton.

The blank, and hence the carton formed therefrom, comprises a pair of bottom panels with a single divider wall therebetween, each of the bottom panels having an outer end wall integral therewith and to the opposite edge thereof from the divider wall. Each bottom panel further has a pair of opposed side panels with the corresponding side panels of the two bottom panels defining opposed carton side walls. Appropriate glue flaps secure the panels and walls in the erected position thereof with one bottom panel integral with the lower edges of the divider wall and the corresponding end wall and opposed side panels. The second bottom panel is integrally joined to the top edge of the divider wall and the lower edges of the corresponding end wall and side panels.

Joined in this manner, the carton includes a first compartment with a planar surface-engaging or "horizontal" bottom panel. The second compartment includes a planar bottom panel which extends at an angle from the upper edge of the divider wall to a remote outer bottom panel edge which is in a common plane with the bottom of the first compartment whereby a positive insulating space is formed below the second compartment and between the second and first compartments for both a physical and thermal insulation of the compartments from each other.

The carton of the invention is uniquely adapted for use as an open tray, a tray with a separate coextensive cover closing both compartments, a tray with an integrally formed cover selectively foldable over both compartments, or a tray with an integrally formed cover selectively foldable over and sealing a single compartment.

Other features and advantages of the invention will become apparent from the more detailed description following hereinafter.

BRIEF DESCRIPTION OF THE DRAWINGS

FIG. 5 is a perspective view of an embodiment wherein the carton includes both a tray and a cover or lid integrally formed with the tray;

FIG. 6 is a longitudinal cross-sectional view through this embodiment with the lid closed and locked in position;

FIG. 7 is a perspective view of a further embodiment of the invention wherein the lid integral with the tray closes and locks over only one of the two compartments;

FIG. 8 is an enlarged perspective detail of the engaged lock means securing the lid in its closed position;

FIG. 9 is a longitudinal cross-sectional view with the lid closed, with portions broken away for illustration of the lid locking assembly;

FIG. 10 is a view similar to FIG. 9, with the lid partially open;

FIG. 11 is an exposed perspective view of a further embodiment wherein a separate tray and a separate lid are provided, a portion of the lid being broken away for purposes of illustration;

FIG. 12 is a perspective detail of a corner of the closed carton illustrating a detail of the locking assembly;

FIG. 13 is a longitudinal cross-sectional view taking immediately adjacent one side wall for illustration of lock assemblies at opposed corners; and FIG. 14 is a longitudinal elevational view of the modification.

DESCRIPTION OF PREFERRED EMBODIMENTS

Figure 1:
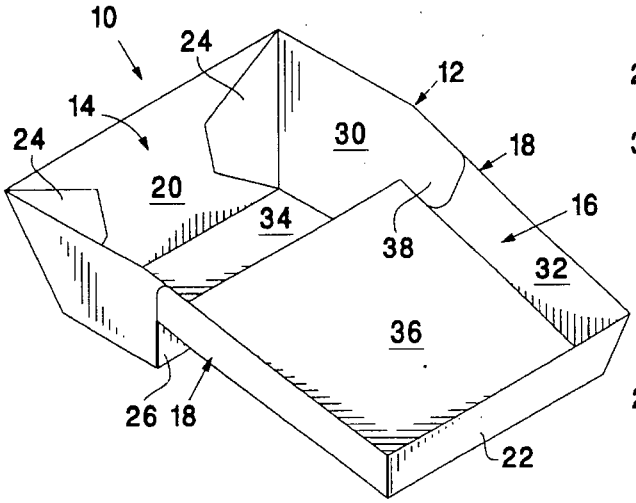
FIG. 1 is a perspective view of the carton of the invention formed in the manner of an upwardly opening tray.

Referring now more specifically to the drawings, attention is initially directed to FIGS. 1–4 wherein the carton 10 of the invention is presented as comprising an upwardly opening food-receiving tray 12 folded from a single sheet of appropriate sheet material. The tray 12 has separate distinct first and second compartments 14 and 16, and includes laterally spaced parallel side walls 18 extending the full length of the compartments 14, 16, a first transverse end wall 20 defining the outer end of the first compartment 14, and a second end wall 22 defining the outer end wall of the second compartment 16.

The end walls 20 and 22 generally parallel each other and are fixed and sealed to the corresponding ends of the side walls 18 by appropriate glue or bonding flaps 24 integrally folded from the corresponding side walls 18 to inwardly overly the corresponding end walls for direct bonding thereto.

The length of the tray 12 is divided by a transverse partition or divider wall 26, the opposite ends of which are fixed to the side walls 18 by appropriate glue flaps 28 integral with the opposed side walls 18 and inwardly turned to overly the face of the divider wall inwardly directed toward the first compartment 14.

Each of the side walls 18 includes a first compartment side wall panel 30 extending the length of the first compartment 14 between the first end wall 20 and the divider wall 26, and a second compartment side wall panel 32 extending the length of the second compartment 16 between the second end wall 22 and the divider wall 26.

With reference to the first compartment 14, the lower edges of the first end wall 20, divider wall 26 and first side wall panels 30 are coplanar and intimately joined, along the full extent thereof, to the periphery of a first planar bottom panel 34. Noting the blank illustrated in FIG. 4, it will be seen that the bottom panel 34 is integral with the respective edges of the walls 20 and 26, and the wall panels 30, all of which are subsequently upwardly folded from the bottom panel 34. This bottom panel 34 comprises the base of the tray 12, providing the main support surface for the tray as it sits on a counter or table top generally suggested at 35 in FIG. 2. As such, the first bottom panel 34, in the normal orientation of the tray, can be considered a horizontal panel.

Referring now to the second compartment 16, a second planar bottom panel 36 is provided therein and has the periphery thereof integrally joined to the upper edge of the divider wall 26 and the lower edge of the second compartment end wall 22. The joinder of the second bottom panel 36 with the lower edge of the corresponding end wall 22 is in a common plane with the first bottom panel 34 for simultaneously supporting engagement therewith on a counter, table top or the like 35. The second compartment, thus formed, slants or slopes downwardly and toward one end of the tray away from the first compartment and the divider wall 26 between the compartments.

Figure 2:
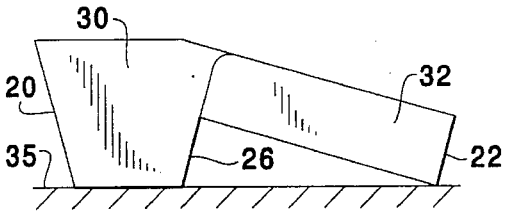
FIG. 2 is a side elevational view of the carton of FIG. 1.
Figure 3:
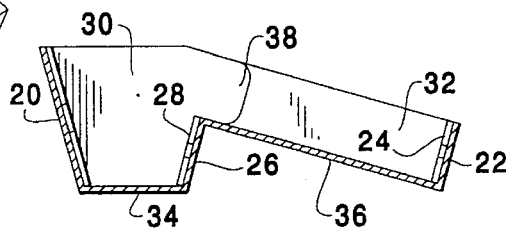
FIG. 3 is a longitudinal cross-sectional view thereof illustrating the two compartments and the relationship therebetween.

The second compartment side wall panels 32 are integral with the opposed side edges of the second bottom panel 36 and upwardly folded therefrom to an upper edge which preferably parallels the bottom panel 36 at a height generally equal to the height of the upper edge of the second end wall 22 relative to this bottom panel 36. Thus, the formed tray 12, in side view or longitudinal cross-section as in FIGS. 2 and 3, presents a multiple compartment tray with the second compartment 16 being of a generally rectangular configuration upwardly sloping from an outer base corner to communicate with the upper portion of a cup-like first compartment 14 above the divider wall 26. It is to be appreciated that the illustrated upward and outward inclination of the first end wall 14 and divider wall 26 relative to each other, as well as a similar slight outward flaring of the opposed side walls 18 of the tray 12 and the outward inclination of the second end wall 22 relative to the horizontal, are of significance in allowing for a nested stacking of the trays, a significant feature in providing for economical shipping and storage of such cartons.

As noted, the side walls 18 are each defined by the first and second side wall panels 30 and 32 respectively integrally folded from the first and second bottom panels 34 and 36. When folded, the corresponding side wall panels 30 and 32 are intimately joined by an extending lug 38 on and coplanar with the first wall panel 30 and extending therefrom into overlapping engagement and bonded joinder to the inner face of the corresponding second side wall panel 32. This relationship will be readily apparent from FIGS. 1 and 3 of the drawings.

The carton tray formed in the above manner provides two permanently separated compartments allowing two items of food to be kept apart to avoid leakage and mixing therebetween, moisture transfer, heat transfer, and the like. Thus, and as an example, a potpie with a hot filling such as gravy, which would produce substantial moisture, can be placed in the same carton as a piece of cornbread, without damaging or soaking the cornbread.

The sloped second compartment 16 allows any moisture build-up in this compartment to drain away from the first compartment 14. Similarly, any moisture build-up in the first compartment will tend to collect at the bottom thereof, well away from the second compartment. In addition, the sloped second bottom panel 36 provides for a distinct air space therebelow which prevents any direct heat transfer to the divider wall 26 which defines the first compartment 14. Also, this inclined bottom panel 36, out of direct contact with any support surface such as a table top, car seat, or the like, greatly reduces any tendency for the build-up of condensate on the support surface both because of the avoidance of direct contact therewith by the second bottom panel 36 and in light of the insulative qualities of the air space.

It is also considered particularly significant that the construction of the tray 12 utilizes substantially less board material than is conventionally required to form a multiple compartment tray with a distinct physical and thermal separation between the compartments.

Figure 4:
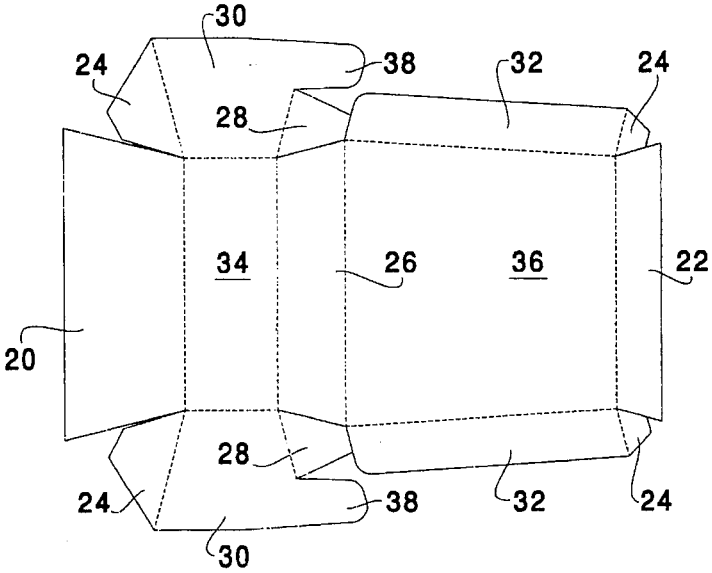
FIG. 4 is a plan view of the blank from which the carton is formed.

With continued reference to the blank of FIG. 4, it will be seen that, other than for the side walls, the main components or panels of the blank are longitudinally aligned. As such, the blank provides a convenient continuous printing surface for any informational or design indica to be applied to the carton. Such material can be applied without interruption and without the necessity for "matching".

A second embodiment of the invention is illustrated in FIGS. 5 and 6 wherein the carton 40 includes both a two-compartment tray 42 and a lid or cover 44. The tray 42 substantially duplicates tray 12 of the first embodiment, and for purposes of illustration like parts have been designated by like reference numerals.

One minor difference involves the formation of the glue flaps 24 integral with the second end wall 22 for overlapping engagement with the opposed second compartment side panels 32, rather than forming these glue flaps 24 integral with the second side panels 32 as in the first embodiment.

More significant, is the portion of a lock assembly integrally formed with the first end wall 20. This comprises an integral inwardly folded flange 46 extending the full length of the upper edge of the end wall 20 and including a coplanar forwardly or outwardly directed elongate locking lug 48 formed from the central upper portion of the end wall 20. The lug is outwardly extended upon an inward folding of the flange 46, and is adapted to releasably engage within a complementary component on the cover 44 upon a closing of the cover 44 over the tray.

The cover 44 includes a planar substantially rectangular top panel 50 with inner and outer end walls 52 and 54 and opposed side walls 56 integral with the four peripheral edges of the top panel 50. In the open position of the cover 44, the walls 52, 54, 56 are upwardly folded from top panel 50 at a slightly outward flaring angle. The adjoining ends of the walls 52, 54, 56 are suitable joined by bonding flaps 58.

The upper or outer edge of the inner end wall 52 is integrally formed with the outer edge of the second end wall 22 of the tray 42 with a fold line formed therebetween. The cover 44 is dimensionally slightly larger than the upper open face of the tray 42 so as to close thereover, noting FIG. 6, with the tray side walls 18 and first end wall 20 received inward of the corresponding walls 56 and 54 of the cover. The height of the cover inner wall 52 is, in conjunction with the height of the second end wall 22 of the tray 42, such as to equal the height of the tray first end wall 20 whereby the cover top panel 50 rests on the upper edges of the first compartment side wall panels 30 and parallels the first compartment bottom panel 34 to basically provide a horizontal planar upper surface which in turn facilitates a stacking of closed or filled cartons.

In order to accommodate the locking lug 48 on the tray end wall 20, the outer end wall 54 of the cover, immediately adjacent the top panel 50, includes a lug-receiving slot 60 therethrough. The material removed to form the slot 60 can be retained as a coplanar extension 64 of the top panel 50 for use as a guide and/or protective means for the lug 48 to prevent accidental release.

Noting FIG. 6, upon a closing of the cover, through a flexing of either or both of the tray end wall 20 and the cover outer wall 54, the lug 48 will snap-lock through the slot 60 immediately adjacent the cover top panel 50 for a retention of the cover until such time as the end wall 20 of the tray is manually inwardly flexed to release the lug 48 from the slot 60, thus providing a positive and effective closure.

A further embodiment of the invention is illustrated in FIGS. 7–10, and includes a carton 62 comprising a tray 64 and a lid 66 integral therewith.

The tray 64, similar to the previously described trays 12 and 42, includes first and second compartments 68 and 70 defined by a transverse divider wall 72. The horizontal bottom panel 74 of the first compartment 68 is integrally folded from the lower edge of the divider wall 72 and extends horizontally to provide a planar support surface integrally joined to the lower edges of a first rear end wall 76 and opposed first side wall panels 78.

The bottom panel 80 of the second compartment 70 has one edge thereof coextensive and integral with, and folded relative to, the upper edge of the divider wall 72 to slope downwardly and outwardly from this upper edge. The bottom panel 80 terminates in an outer edge remote from the divider wall in a common plane with the first bottom panel 74. An upwardly directed second end wall 82 is integral with the remote outer edge of the bottom panel 80 and parallels the first end wall 76 and divider wall 72. The second compartment 70 is completed by opposed second side wall panels 84, the upper edges of which are generally horizontal, parallelling the corresponding upper edges of the first side wall panels 78 but stepped downwardly therefrom. Thus formed, the second side wall panels 84, relative to bottom panel 80, taper from a maximum height at the outer end wall 82 to a distinct but minimum height at the divider wall 72. As with the previously defined trays, each pair of side wall panels 78 and 84 are bonded together at overlapping inner end portions and define a single tray wall.

The upper edge of each of the second side wall panels 84, immediately adjacent the forward edge of the first side wall panel 78, has a V-shaped notch 86 therein. The forward edge of each first side wall panel 78, immediately adjacent the upper edge thereof, is provided with a forwardly projecting lug 88 overlying the corresponding recess 86 in upwardly spaced relation thereto. The lug 88, as illustrated, will preferably have a downwardly inclined or beveled outer edge.

The cover 66 includes an inner end wall 90 integral with the upper edge of the first end wall 76 along the upper edge thereof with a folding hinge line defined therealong. The cover 66 further includes a top panel 92 integral with the inner end wall 90 and with a corresponding outer end wall 94 and opposed cover side walls 96. The outer end wall 94 is substantially higher than the inner end wall 90 and is joined to the side walls 96 by integral glue flaps 98 on the adjoining ends of the side walls 96 which are folded to lie against the inner surface of the outer end wall 94 for direct bonding thereto. The outer end wall 94 includes a central projecting portion 100 terminating in the end wall outer edge 102 and having opposed generally converging side edges 104 inwardly offset from the corresponding side walls 96 and extending from the outer edges of the glue flaps to the outer edge 102 of the extension 100. The glue flap upper edges, with the corresponding edge portions of end wall 94 inward of the projecting portion 100, define a pair of shoulders or shoulder portions 106.

Immediately below the shoulders 106, each of the glue flaps 98 and the corresponding portion of the first end wall 94 are provided with an opening 108 therethrough. Each opening 108 is immediately adjacent the corresponding side wall 96 with the side wall 96 having a projecting coplanar lug 110 extending beyond the first end wall immediately adjacent the opening 108.

The cover 66 is intended to close only the first compartment 68, and is appropriately dimensioned to do so, with the cover top panel 92 being only slightly greater than the first compartment bottom panel 74. The outward tapering of the walls of the cover, in addition to facilitating stacking of the open cartons, also allows for a smooth closing of these walls over and immediately outward of the first compartment side panels 78.

FIG. 10 illustrates the cover partially closed and prior to engagement of the tray lugs 88 through the corresponding locking openings 108. FIGS. 8 and 9 illustrate the fully closed cover 66 wherein the tray lug 88 engages through the cover opening 108 and extends beyond the outer face of the cover outer end wall 94 immediately adjacent the projecting tabs 110 on the cover side walls. When fully engaged, it will be noted that the extension 100 of the outer cover end wall 94 is received within the second compartment 70 slightly spaced from the divider wall 72 and in close conformance with the opposed second compartment side wall panels 84. At the same time, the cover shoulders 106 are received within the corresponding notches 86. This in turn stabilizes the cover outer end panel 94 and acts to positively retain the end wall 94 with the locking lugs 88 received through the end wall openings 108. In other words, the notches 86 tend to prevent a forward shifting of the end wall as might accidently release the locking lugs 88. Similarly, the extensions 110 adjacent each of the lug-receiving openings 108 prevent accidental engagement with or withdraw of the lugs 88.

Notwithstanding the positive locking and sealing of the cover, manual release thereof, for access to the contained foodstuff, is easily effected by merely inwardly flexing the opposed cover side walls 96. This in turn causes a slight forward bulging of the cover outer wall 94 and a release of the locking lugs 88 from the openings 108. Once released, the cover is easily upwardly and rearwardly swung to expose the contents of the first compartment 68. As with the previously described embodiments, the divider wall 72 and the sloping bottom 80 of the second compartment 70 ensure a positive segregation and thermal insulation of the foods from each other.

A final embodiment to be specifically illustrated is shown in FIGS. 11–14, and includes a separate tray 112 and cover 113.

The tray 112 differs from the previously described trays in that the first compartment 114, that compartment including the horizontal bottom panel 116 integral with the lower edge of the divider wall 118, is substantially longer than the second compartment 120 having the inclined or sloped bottom panel 122 integral with the upper edge of the divider wall 118. The opposed side walls 124, each formed of a pair of end bonded side wall panels, include continuous upper edges paralleling the first compartment bottom panel 116, and thus being substantially horizontal. The opposed end walls 126 and 128 similarly have coplanar substantially horizontal upper edges offset slightly downward from the upper edges of the side walls 124. In other words, the side walls 124 are slightly higher than the end walls 126, 128.

Each of the side walls 124, at the upper corners of the opposed ends thereof, includes a coplanar projecting lug 130 extending beyond the outer face of the corresponding end wall 126, 128. Each of these lugs 130 is of a double thickness, formed from both the corresponding side wall 124 and a corresponding corner securing glue flap 132. The outer edge of the double thickness lugs 130 can be slightly bevelled to facilitate a mounting of the cover 113 as described presently. As will be best noted from the illustration of the tray in FIG. 11, the glue flaps 132, integrally formed with the end walls 126, 128, can, as appropriate, overly either the inner or outer faces of the side walls 124.

As with the previously described trays, the sloping bottom panel 122 of the second compartment 120 defines a positive insulating space between this bottom panel 122 and the adjoining first compartment 114, or more particularly the divider wall 118 which defines the compartments. A positive spacing is also provided between the second compartment bottom panel 122 and any counter top or similar support surface.

The cover 113 includes a top panel 134 with integral depending and slightly outwardly flaring side walls 136 and end walls 138. Each of the end walls 138, at the opposed upper corners thereof immediately below the top panel 134, includes a lug-receiving opening 140 therethrough. Structurally, each opening 140 will be formed by appropriate aligned recesses or cutouts in the end wall 138 and the corresponding corner glue flap 142 as will be best appreciated from the broken away corner in FIG. 11.

When the cover 113 is to be mounted, the cover is moved downward over the tray 112, with the beveled outer edges of the locking lugs 130 riding along the inner surfaces of the end walls 138 until they snap-lock into the corresponding openings 140. The inherent flexible nature of the material of the carton facilitates both the engagement and disengagement of the lugs in an obvious manner. When the cover 113 is fully mounted, the top panel 134 thereof will sit flush on the upper edges of the opposed side walls 124 and will be slightly spaced above the upper edges of the end walls 126 and 128 thereby providing a venting function.

The slight outward tapering of the walls 136 and 138 of the cover 114 facilitate an engagement over and immediately outward of the tray walls. In addition, the tapering is significant in allowing for a nested stacking of the covers. Similarly, the slight outward inclination of the tray walls, including the divider wall 118, is also significant for allowing for a compact nesting of multiple trays.

The foregoing embodiments all incorporate and are illustrative of the significant features of the invention. However, these embodiments are not to be considered as a limit to the scope of the invention, which is to be limited only by the claims following hereinafter.

I claim:

1. A food carton comprising a tray with adjacent first and second food retaining compartments, said first compartment including a first bottom panel defining a support plane for said carton, said second compartment communicating with said first compartment in spaced relation above said first bottom panel, said second compartment including a second bottom panel inclined outward and downward from said first compartment to an outer end in said support plane.

2. The carton of claim 1 wherein said tray includes first and second outer end walls respectively defining an outer end wall of said first compartment and an outer end wall of said second compartment, said tray including opposed side walls extending between said first and second outer end walls, and an intermediate wall extending transversely between said opposed side walls intermediate said outer end walls and defining said first and second compartments to opposed sides thereof.

3. The carton of claim 2 wherein said intermediate wall has a bottom edge and a top edge, said first bottom panel being joined directly to said intermediate wall bottom edge, said second bottom panel being joined directly to said intermediate wall upper edge.

4. The carton of claim 3 wherein said first and second bottom panels are integral with the corresponding edges of said intermediate wall with fold lines defined therealong.

5. The carton of claim 3 wherein each of said opposed side walls comprises first and second substantially coplanar side wall panels respectively coextensive with said first and second compartments between the outer end walls thereof and said intermediate wall.

6. The carton of claim 5 wherein each of said side wall panels has an upper edge in a plane substantially parallel to said first bottom panel.

7. The carton of claim 5 wherein said first side wall panels have coplanar upper edges substantially paralleling said first bottom panel, said second side wall panels having coplanar edges substantially parallelling said second bottom panel.

8. The carton of claim 5 wherein said first end wall and said intermediate wall diverge upwardly relative to each other from said first bottom panel.

9. The carton of claim 5 including a cover removably overlying said tray, and lock means for releasably securing said cover to said tray, said lock means including projecting lug means on at least one of said walls of said tray and complementary opening means on said cover for receiving said lug means upon a closing of said cover over said tray.

10. The carton of claim 9 wherein said cover includes a top panel, opposed side walls, and first and second end walls, said first cover end wall being joined to one of said end walls of said tray with a fold line defined therebetween for selective pivotal movement of said cover between an open position remote from said tray and a closed position overlying said tray, said opening means of said lock means being defined through said second cover end wall.

11. The carton of claim 10 wherein said cover, in the closed position thereof, overlies and closes only said first compartment, said side wall panels of said first compartment having forward edges, said lug means comprising a lug on each said forward edge extending in spaced relation above said second side wall panels for selective engagement through said cover opening means upon movement of said cover to said closed position, said opening means comprising a separate opening for each of said lugs.

12. The carton of claim 11 wherein each of said second side wall panels includes an upwardly opening notch defined therein aligned in space relation to and below a corresponding one of said lugs, said second cover end wall having shoulders defined thereon and engagable within said notches as said lugs engage in said openings in the closed position of said cover.

13. The carton of claim 12 wherein said second end wall of said cover, between said shoulders, extends into engagement with said second bottom panel in the closed position of said cover.

14. The carton of claim 10 wherein said cover extends over and closes both compartments, said cover, in the closed position thereof, being in upwardly spaced relation to said intermediate wall wherein direct communication is provided between said compartments with foods received therein being segregated.

15. The carton of claim 9 wherein said cover overlies and closes only said first compartment, said side wall panels of said first compartment having forward edges, said lug means comprising a lug on each said forward edge extending in spaced relation above said second side wall panels for selective engagement through said cover opening means upon movement of said cover to said closed position, said opening means comprising a separate opening for each of said lugs.

16. A food carton for fast food, said carton comprising a tray with adjacent first and second compartments, said first compartment including a first bottom panel with peripheral walls extending upward therefrom for receiving and confining food therein, said second compartment including a second bottom panel fixed to a first wall of said peripheral walls in upwardly spaced relation to said first bottom panel, said second bottom panel being inclined outward and downward from said first compartment and terminating in an outer edge substantially in a common plane with said first bottom panel, said second compartment including an end wall along and extending upward from said outer edge of said second bottom panel, and laterally spaced opposed side wall panels fixed to said second bottom panel and extending from said end wall to said first compartment for receiving and confining food in said second compartment, said inclined second bottom panel separating food received in said second compartment from food received in said first compartment.

17. The carton of claim 16 wherein said second bottom panel is vertically and laterally remote from said first bottom panel, said second bottom panel and said first wall of said peripheral walls of said first compartment defining an insulating space therebetween.

18. The carton of claim 17 including a cover removably overlying said tray, and lock means releasably securing said cover to said tray, said lock means including projecting lugs on selected ones of said walls of said tray and complementary openings in said cover for receiving said lugs upon a closing of said cover over said tray.

19. The carton of claim 18 wherein said cover overlies and closes only said first compartment, said peripheral walls of said first compartment including side walls having forward edges with said lugs defined thereon and extending in spaced relation above said side wall panels of said second compartment for selective engagement through said cover opening upon movement of said cover to a closed position.

20. A carton for receiving and segregating diverse foodstuffs, said carton comprising a tray including spaced opposed side walls, first and second spaced end walls extending between and joined to said side walls, a divider wall extending transversely across said tray and joined to said opposed side walls in spaced relation to each of said first and second end walls and defining first and second food compartments respectively, each of said side and end walls and divider wall having an upper edge and a lower edge, said first compartment including a bottom panel extending between said first end wall and said divider wall, and having a periphery joined to the lower edges of said side walls, said first end wall and said divider wall, said second compartment including a bottom panel extending between said second end wall and said divider wall, and having a periphery joined to the upper edge of said divider wall and the lower edges of said side walls and said second end wall.

* * * * *